US009003837B2

(12) United States Patent
Cassidy

(10) Patent No.: US 9,003,837 B2
(45) Date of Patent: Apr. 14, 2015

(54) APPARATUS INCLUDING A PLURALITY OF SPRAY DISTRIBUTION NOZZLES FOR WASHING ARTICLES WITHOUT AGITATION

(76) Inventor: Adrian Cassidy, Liverpool (GB)

( * ) Notice: Subject to any disclaimer, the term of this patent is extended or adjusted under 35 U.S.C. 154(b) by 794 days.

(21) Appl. No.: 11/917,455

(22) PCT Filed: Jun. 15, 2006

(86) PCT No.: PCT/GB2006/002188

§ 371 (c)(1),
(2), (4) Date: Dec. 13, 2007

(87) PCT Pub. No.: WO2006/134364

PCT Pub. Date: Dec. 21, 2006

(65) Prior Publication Data

US 2009/0235464 A1 Sep. 24, 2009

(30) Foreign Application Priority Data

Jun. 15, 2005 (GB) ..... 0512123.1

(51) Int. Cl.
*D06F 17/04* (2006.01)
*D06F 58/10* (2006.01)
*D06F 39/00* (2006.01)

(52) U.S. Cl.
CPC ..... *D06F 17/04* (2013.01); *D06F 39/003* (2013.01); *D06F 58/10* (2013.01)

(58) Field of Classification Search
USPC ..... 68/5 R, 5 C, 12.04, 20
See application file for complete search history.

(56) References Cited

U.S. PATENT DOCUMENTS

| | | | | |
|---|---|---|---|---|
| 2,699,661 | A * | 1/1955 | Olson | 68/205 R |
| 2,741,113 | A * | 4/1956 | Norkus | 68/205 R |
| 2,842,144 | A * | 7/1958 | Lyman | 134/57 D |
| 2,845,786 | A * | 8/1958 | Chrisman | 68/18 R |
| 3,114,919 | A * | 12/1963 | Kenreich | 8/147 |
| 3,166,923 | A * | 1/1965 | Zacks | 68/5 C |
| 3,672,188 | A * | 6/1972 | Geschka et al. | 68/12.15 |
| 3,683,651 | A * | 8/1972 | Mazza | 68/20 |
| 3,868,835 | A * | 3/1975 | Todd-Reeve | 68/20 |
| 4,989,624 | A | 2/1991 | Darling | |

(Continued)

FOREIGN PATENT DOCUMENTS

WO WO2004/091359 A 10/2004

OTHER PUBLICATIONS

Oxford English Dictionary—fixed adj.*

*Primary Examiner* — Joseph L Perrin
(74) *Attorney, Agent, or Firm* — McKee, Voorhees & Sease

(57) ABSTRACT

This invention relates to a method and apparatus for washing articles. Said method and apparatus enabling efficient cleaning and drying of garments and other items within a receptacle (29) having no rotational components. In a preferred embodiment, this is achieved by providing at least one receptacle (29) for containing the washing articles, the receptacle (29) having a plurality of subdivisions for accommodating separate articles. The present invention also includes a plurality of spray distribution nozzles (15, 16) to direct a suitable quantity of water and detergent onto the separate washing articles and then controlling a predetermined cycle of washing and rinsing. As the washing articles are washed and dried separately, the creases that are associated with prior art washing machines are significantly reduced, and the garments are ready to wear without the further laborious and time-consuming task of ironing.

15 Claims, 7 Drawing Sheets

(56) References Cited

U.S. PATENT DOCUMENTS

| | | | | | |
|---|---|---|---|---|---|
| 4,997,000 | A * | 3/1991 | Feast et al. | 134/170 |
| 5,131,419 | A * | 7/1992 | Roberts | 134/50 |
| 5,165,260 | A * | 11/1992 | Geiger | 68/12.04 |
| 5,225,160 | A * | 7/1993 | Sanford et al. | 422/28 |
| 5,644,936 | A * | 7/1997 | Yasutake et al. | 68/12.02 |
| 5,729,025 | A * | 3/1998 | Erickson et al. | 250/574 |
| 5,800,628 | A * | 9/1998 | Erickson et al. | 134/18 |
| 2002/0001537 | A1 * | 1/2002 | Hlebovy et al. | 422/28 |
| 2004/0112095 | A1 * | 6/2004 | Bolduan et al. | 68/5 C |
| 2004/0206131 | A1 * | 10/2004 | Kleker | 68/5 C |
| 2005/0081895 | A1 * | 4/2005 | Miyauchi et al. | 134/58 D |
| 2005/0262883 | A1 * | 12/2005 | Yang et al. | 68/12.01 |

* cited by examiner

APPARATUS INCLUDING A PLURALITY OF SPRAY DISTRIBUTION NOZZLES FOR WASHING ARTICLES WITHOUT AGITATION

This invention relates to a method and apparatus for washing articles. The method and apparatus enabling efficient cleaning and drying of garments and other items within a receptacle having no rotational components.

At the present time, washing machines are widely used industrial and domestic appliances, utilising a drum or other mechanical device to agitate the washing in a water and detergent mixture. Generally, with top loading washing machines, a separate agitator perturbs the items in the water and detergent mixture to facilitate cleaning. After washing, the drum spins at a high speed to remove the water and detergent. The basket is then filled with water again, and the washing is subjected to a succession of rinse and spin cycles. Generally, around 150 liters of water may be used in a regular domestic wash cycle.

Alternatively, front loading washing machines have a door on the front through which the operator places items of washing and detergent. Front loading washing machines then fill with water to just below the level of the door opening and, in use, items tumble in and out of the water using baffles or fins located around the inside of the drum. Again, the items are spun to remove the water and detergent, rinsed and spun dry. Generally, these washing machines use less detergent, electricity and water, typically 70 to 90 liters in a domestic front loading wash cycle. In recent years, combination washer dryers have become increasing popular, wherein after the spin cycle, heated air is passed into the rotating drum and the moisture given off by drying garments is either pumped away into the drains or collected in a reservoir.

However, since these prior art washing machines rely on the rotation of a drum or other mechanical device to agitate the washing, they often require substantial frames and counterbalances to restrict vibration and unwanted movement. As such, these appliances tend to be extremely heavy and are usually floor mounted. For these reasons, prior art washing machines are generally located in a kitchen or utility room and not at the point of use, which could be, for example, a bedroom or bathroom. The capacity of the drum may also be reduced to incorporate the agitator. Also, gaskets and seals, which must be able to withstand such rotational movement, are more likely to deteriorate and fail. Additionally, since the garments are generally intermingled after the washing and drying cycles, such tend to be creased and requiring the further task of ironing, which can be both time-consuming and laborious.

It is the object of the present invention to provide a method and apparatus for washing articles. Said method and apparatus enabling efficient cleaning and drying of garments and other items in a receptacle containing a suitable quantity of water and detergent, wherein the receptacle has no rotational components. In one embodiment, the dissolved detergent is able to contact with the articles by providing a receptacle having a plurality of subdivisions for accommodating separate articles and spraying the washing articles with a suitable quantity of water and detergent. In a further embodiment, by providing a receptacle having a plurality of subdivisions for accommodating separate articles, the washing articles can be immersed into the dissolved detergent for a certain amount of time before being subject to a series of rinsing and drying cycles. In use, as the articles are retained separately, the creases normally associated with prior art washing machines are significantly reduced.

According to the present invention, there is provided a method for washing articles, comprising the steps of:

providing at least one receptacle for containing said articles, said at least one receptacle having a plurality of subdivisions for accommodating separate articles;

providing a plurality of spray distribution nozzles to direct a suitable quantity of water and detergent onto said separate articles; and controlling a predetermined cycle of washing and rinsing.

Also according to the present invention there is provided an apparatus for washing articles, comprising:

at least one receptacle for containing said articles, said at least one receptacle having a plurality of subdivisions for accommodating separate articles;

a plurality of spray distribution nozzles to direct a suitable quantity of water and detergent onto said separate articles; and control means for controlling a predetermined cycle of washing and rinsing.

In a preferred embodiment, efficient cleaning of articles may be facilitated by providing a receptacle having a plurality of subdivisions for accommodating separate articles.

Preferably, said receptacle may preferably comprise a non-rotating drum or other container to accommodate the articles, water and detergent mixture. In this way, the receptacle may be provided as a cabinet or enclosure which can be accessed via a door or hatch.

Further preferably, the plurality of subdivisions for accommodating separate articles are provided as a plurality of clothes hangers on which, in use, said articles of washing are hung such that a suitable quantity of water and detergent is able to contact the articles for a predetermined time to facilitate dirt removal, prior to rinsing and drying. Each of said plurality of clothes hangers includes a hanger mount for ease of attachment to a hanger rail in said receptacle. Each of said plurality of clothes hangers includes a plurality of apertures situated around its surface to minimise the contact area between such and said articles.

In use, said plurality of spray distribution nozzles may comprise a plurality of overhead spray distribution nozzles located at the top of said receptacle and also a plurality of side spray distribution nozzles that are located approximately in the vicinity of where the armpit of a garment, such as a shirt, blouse or jumper is likely to be positioned. The position of said plurality of spray distribution nozzles ensures that the areas of garments where dirt and grime is most likely to accumulate (i.e., around the neck, armpits and shoulders) is liberally supplied with said water and detergent.

Preferably, each of said plurality of spray distribution nozzles comprises an elongate tubular member having various apertures located around its periphery and which are used to direct a suitable quantity of water and detergent onto said separate articles.

Further preferably, the control of the washing cycle is provided by a control means which may be implemented using an electromechanical device or electronic controller. As the articles of washing are loaded into the machine, prior to the start of the washing cycle, their weight may be assessed using at least one strain gauge or other transducer. In this way, the length and type of washing cycle, as selected by the operator, may be subsequently adjusted by the control means to the specific weight requirements. The operator then adds detergent to the dispensing tray; the correct level of such detergent may be identified using indicator means corresponding to the particular weight of washing. In use, said indicator means may be provided using load line indicators in the dispensing tray. Alternately, an automatic quantity of detergent may be supplied, via a soap dispenser valve, dependent on the weight of such washing.

In use, as the washing cycle commences, the control means measures and controls the temperature of the water entering the receptacle. In use, the temperature of the water entering the receptacle is heated using a conventional element or a microwave system.

Preferably, after the completion of the washing cycle, the articles may be subjected to a succession of rinse and drying cycles. During drying, the pressure, temperature and humidity of the air in said receptacle may be controlled such that the articles are dried efficiently.

Further preferably, a dirt detection device may also be situated in close proximity to the articles contained in at least one receptacle. The dirt detection device being able to recognise various types of dirt or stains located on the washing articles from properties such as dirt particle size, chemical analysis or other transmission and/or reflection parameters. The output of the dirt detection device is fed to the control means which then determines a preferred washing powder and concentration.

Further according to the present invention, there is provided a method for washing articles, comprising the steps of:

providing at least one receptacle for containing said articles, together with a suitable quantity of water and detergent, said at least one receptacle having a plurality of subdivisions for accommodating separate articles; and controlling a predetermined cycle of washing and rinsing.

Likewise according to the present invention there is provided an apparatus for washing articles, comprising:

at least one receptacle for containing said articles, together with a suitable quantity of water and detergent, said at least one receptacle having a plurality of subdivisions for accommodating separate articles; and control means for controlling a predetermined cycle of washing and rinsing.

In a further embodiment, efficient cleaning of articles may be facilitated by providing an open receptacle having a plurality of subdivisions for accommodating separate articles. In use, the suitable quantity of water and detergent is able to contact the articles for a predetermined time to facilitate dirt removal, prior to rinsing. The plurality of subdivisions may be provided as a plurality of clothes hangers for immersing the articles in the suitable quantity of water and detergent, or as a basket having a plurality of compartments for accommodating separate articles.

It is believed that a method and apparatus for washing articles in accordance with the present invention at least addresses the problems outlined above. In particular, the advantages of the present invention are that the absence of a rotating drum or other mechanical device to agitate the washing allows for an open receptacle with an increased capacity. By providing a receptacle having a plurality of subdivisions for accommodating separate articles allows the dissolved detergent to contact the articles to facilitate rapid dirt removal. In this way, as the articles are retained separately, the creases normally associated with prior art washing machines are significantly reduced. Also, the need to install heavy counterbalances to restrict vibration and unwanted movement is obviated since there are no rotational elements and, as such, the present invention may be constructed from lighter materials and is capable of being mounted above floor level. As such, there is no standard unit size or shape, so that the present invention can be located at the point of use which could be the bathroom, bedroom or in a hotel room. The present invention makes effective and efficient use of water, such that, water heating time and costs are also reduced.

It will be obvious to those skilled in the art that variations of the present invention are possible, and it is intended that the present invention may be used other than specifically as described herein.

A specific non-limiting embodiment of the invention will now be described by way of example and with reference to the accompanying drawings, in which.

Figure 1:
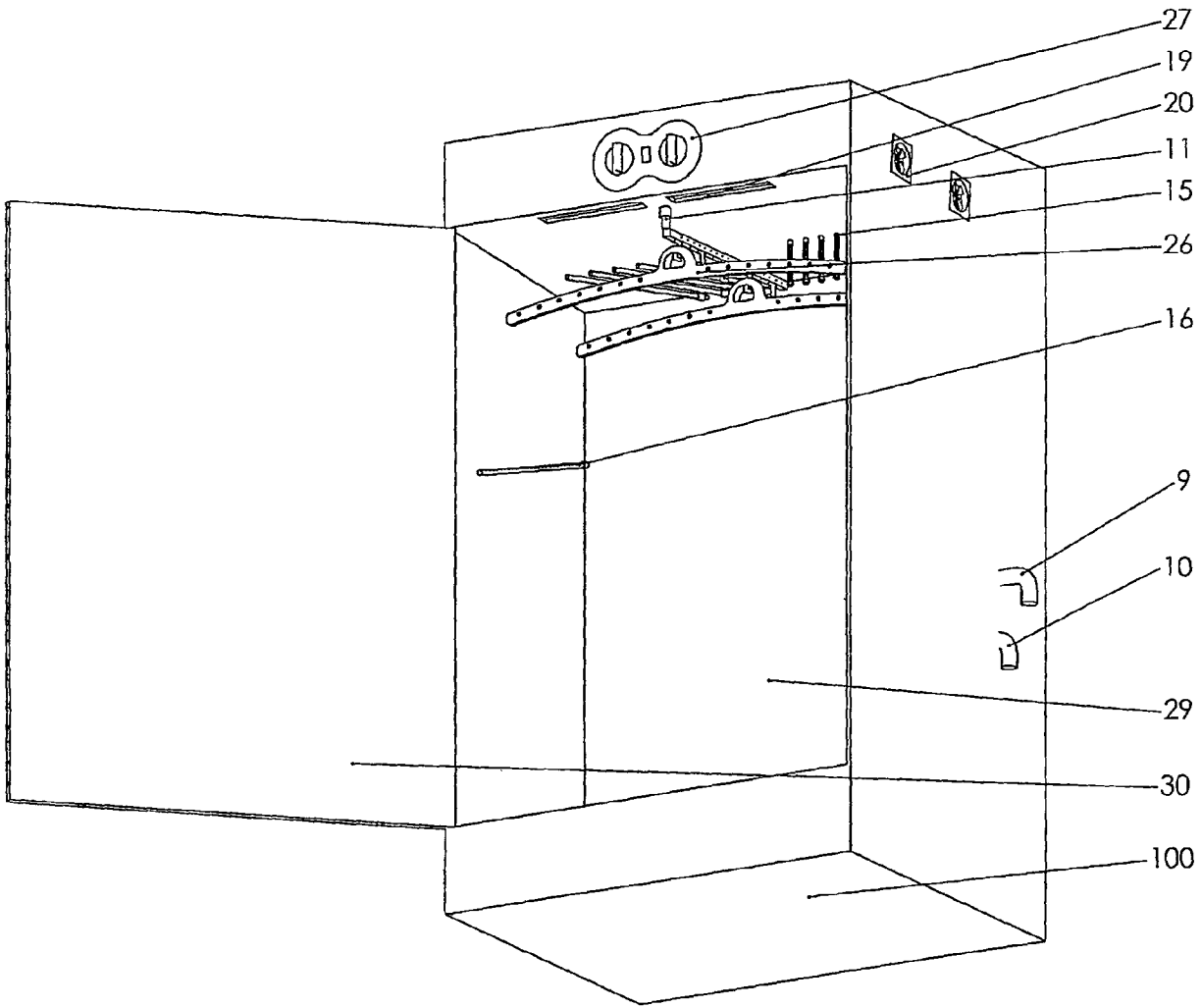
FIG. 1 illustrates a perspective view of an apparatus for washing articles according to the present invention.

Referring now to the drawings, an embodiment of the present invention is illustrated in FIGS. 1 to 5, which shows an apparatus 100 for washing articles and garments. As shown in FIG. 1, the washing apparatus 100 comprises at least one receptacle 29 or enclosure which is capable of holding a number of garments (not shown). User access to the receptacle 29 is through door 30.

Figure 3:
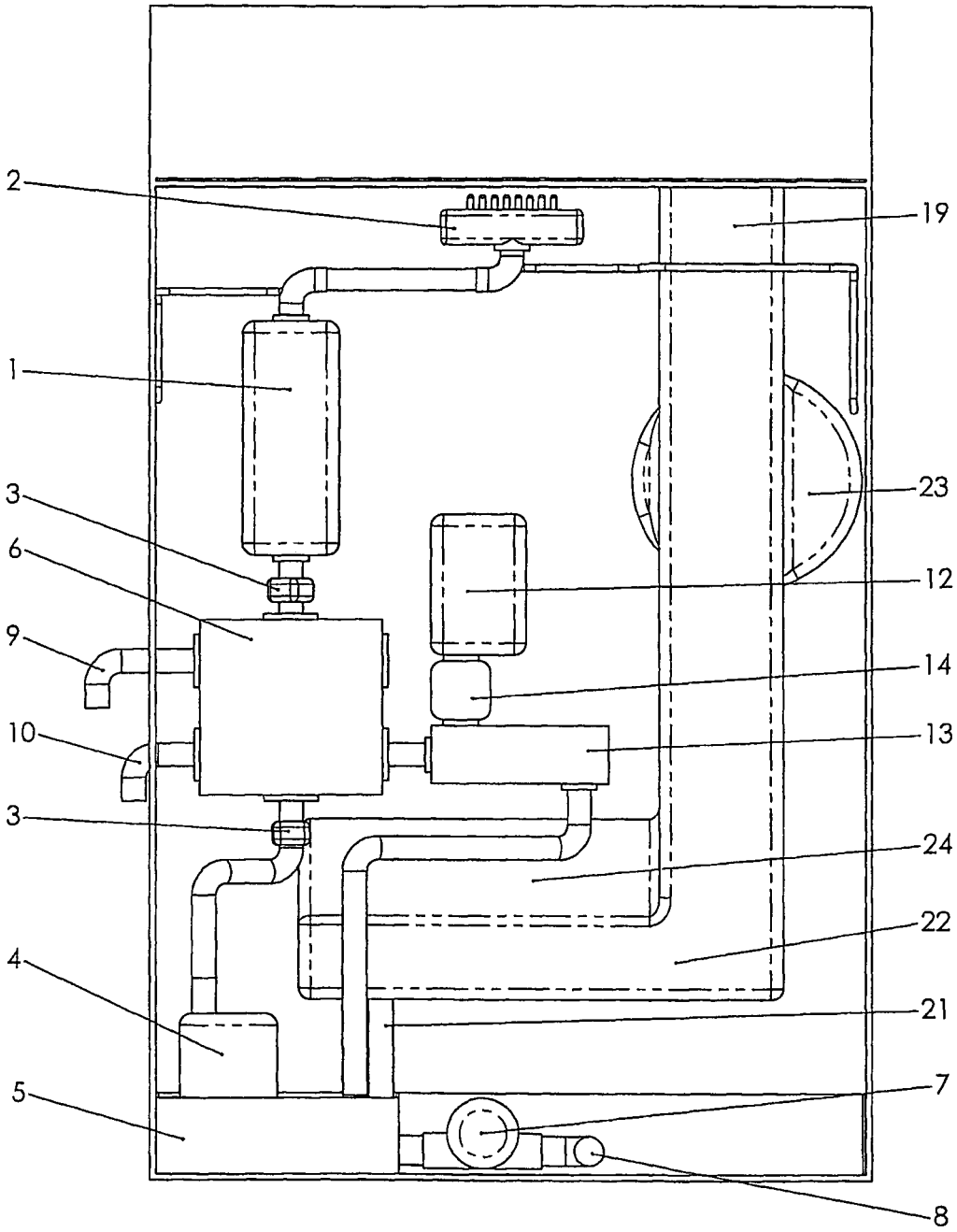
FIG. 3 illustrates a side view of the rear of the apparatus for washing articles according to the present invention.
Figure 4:
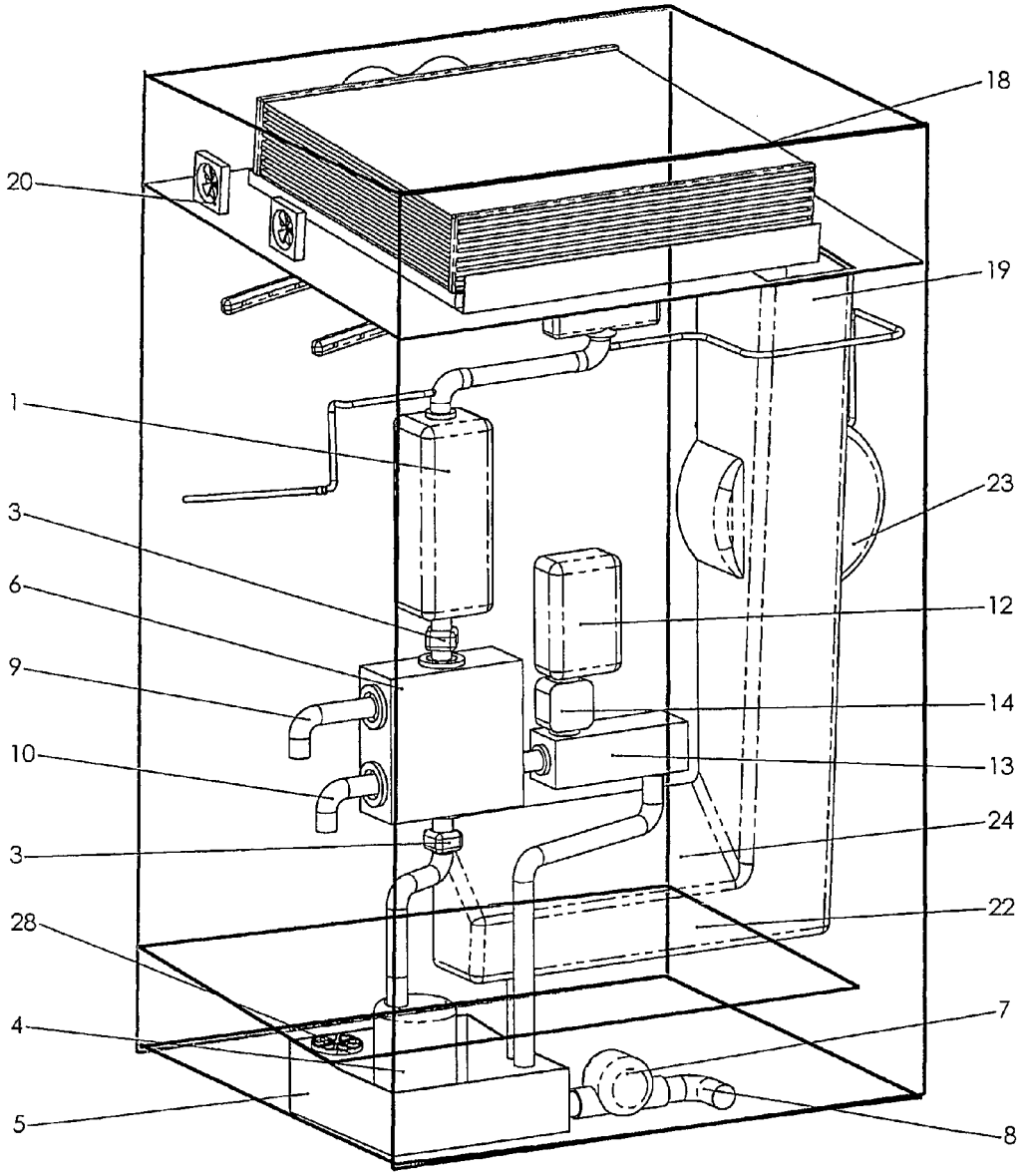
FIG. 4 shows a perspective cutaway view from the rear of the apparatus according to the present invention.

As can be seen most clearly in FIGS. 3 and 4, the present invention includes a water circuit that provides a suitable quantity of water and detergent to facilitate washing of the garments. Thereafter, the cleaned garments are then subject to a series of rinsing cycles. The apparatus 100 includes a cold water inlet 10 and, where appropriate, a hot water source can be connected to hot water inlet 9. The cold water inlet 10 and hot water inlet 9 are connected to a water filter manifold 6, which has a number of inlet and outlet ports. Connected at one inlet to the water filter manifold 6 is a soap tray 13 which further includes a soap dispenser 12 with an appropriate soap dispenser valve 14. In use, a controller (not shown) or other control unit ensures that the correct level of washing medium is supplied to the water filter manifold 6 during a cycle of washing.

The control unit (not shown) also controls the water circuit described herein, and the skilled person will appreciate that for sake of clarity various valves, sensors and actuators are included in the circuit, but which are not specifically discussed. As mentioned above, clean water is preferably taken from two sources; through cold water inlet 10 and hot water inlet 9, or re-circulated from a collector 5, which is mounted beneath the receptacle 29. From whichever source the water is taken, the temperature of the water is continually measured by sensors (not shown) and if any water requires heating, then the appropriate valves (not shown) are opened and closed and water is passed through a water heater 1, before re-entering the circuit. The water heater 1 would be provided using a conventional element, or other heating means such as a microwave heater.

Movement of the water around the water circuit is achieved using a water pump 4 which also includes a non-return valve 3 located at the base of the water filter manifold 6. During a cycle of washing, water supplied at the desired temperature from the water heater 1 is then mixed with a suitable quantity of detergent at the water filter manifold 6 and pumped to a water manifold 2 which then supplies the water and washing medium mixture to a number of spray distribution nozzles 15, 16 located in the receptacle 29.

Figure 2:
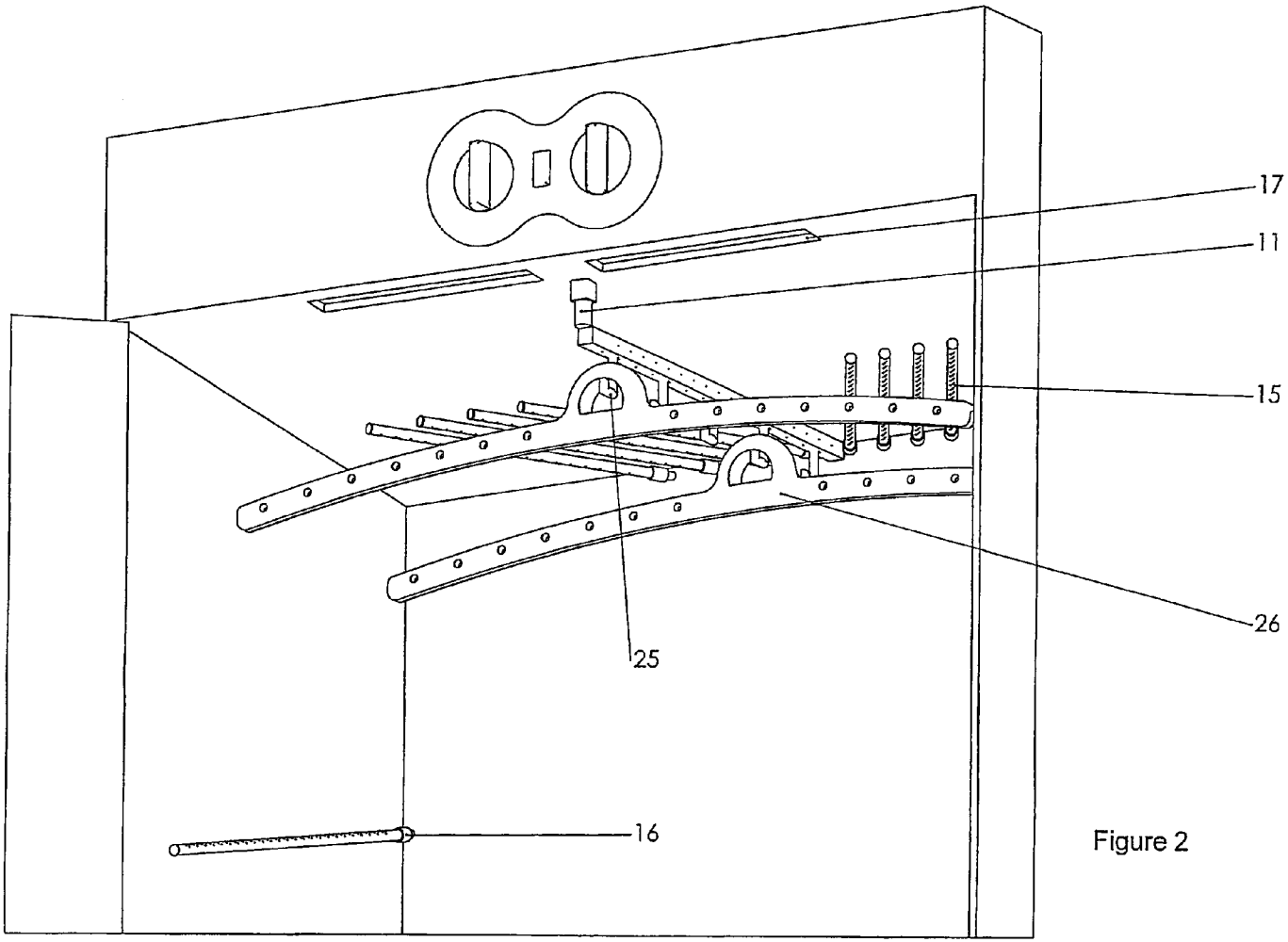
FIG. 2 shows in further detail the arrangement of spray distribution nozzles located inside the receptacle.
Figure 6:
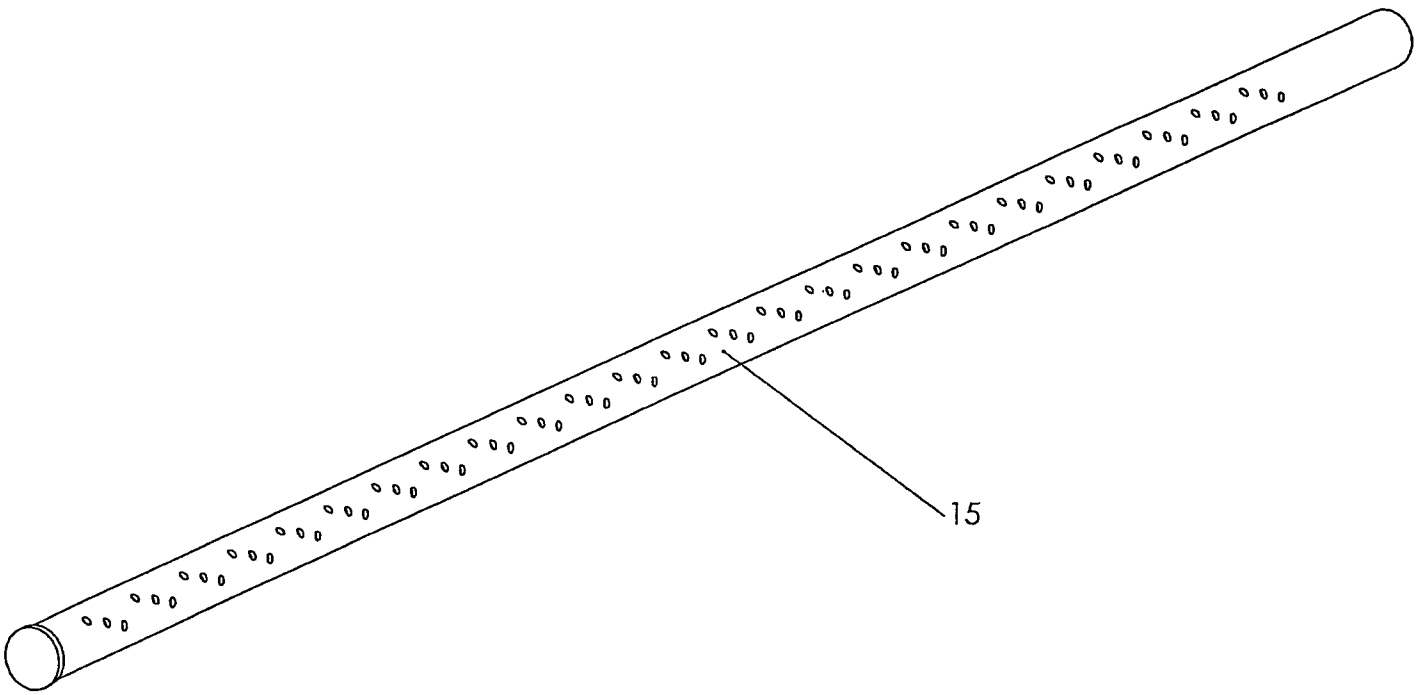
FIG. 6 shows further detail of the spray distribution nozzles shown in FIGS. 1 to 5.

As clearly shown in FIGS. 1 and 2, there are a plurality of overhead spray distribution nozzles 15 located at the top of the receptacle 29 and also a plurality of side spray distribution nozzles 16 that are located approximately in the vicinity of where the armpit of a garment, such as a shirt, blouse or jumper is likely to be positioned on the clothes hangers 26. The position of the overhead spray distribution nozzles 15 also ensures that the areas of garments where dirt and grime is most likely to accumulate (i.e., around the neck and shoulders) is liberally supplied with the water and washing medium mixture. Further detail of the spray distribution nozzles 15, 16 is shown in FIG. 6.

At the end of the washing cycle, again under the control of the control means (not shown), waste water pump 7 is activated which removes the waste water collected through drain hole 28, and such is pumped to the drains via a waste water outflow pipe 8.

In use, the operator loads the machine 100 through door 30 and then makes a cycle selection using the control panel 27. The cycle selection being confirmed by a multi-function display (not shown), and such washing cycle is then sequenced by the control unit (not shown). It is also envisaged that the weight of washing can also be measured by a balance rail 11 on which the clothes hangers 26 are hung. This may be provided using a strain gauge 51 (see FIG. 5) or other transducer and the most appropriate amount of water and detergent for the weight of washing can be determined by the control unit (not shown). In one embodiment, the correct level of washing medium is then indicated to the operator in dispenser tray 13 using load line indicators or, alternatively, an automatic quantity of washing medium can be supplied via soap dispenser valve 14.

As shown in FIGS. 1 and 2, an open receptacle 29 is provided which has a plurality of subdivisions for accommodating separate articles. In use, the plurality of subdivisions are provided as a plurality of clothes hangers 26 on which articles of washing are hung such that a suitable quantity of water and detergent is able to contact the articles for a predetermined time to facilitate dirt removal, prior to rinsing and drying. Alternatively, the skilled person will appreciate that immersing the garments in a suitable quantity of water and detergent would also be possible, or providing a basket having a plurality of compartments for accommodating separate articles. In this way, the washing articles can be immersed into the dissolved cleaning media for a certain amount of time before being subject to a series of rinsing and drying cycles.

Figure 7:
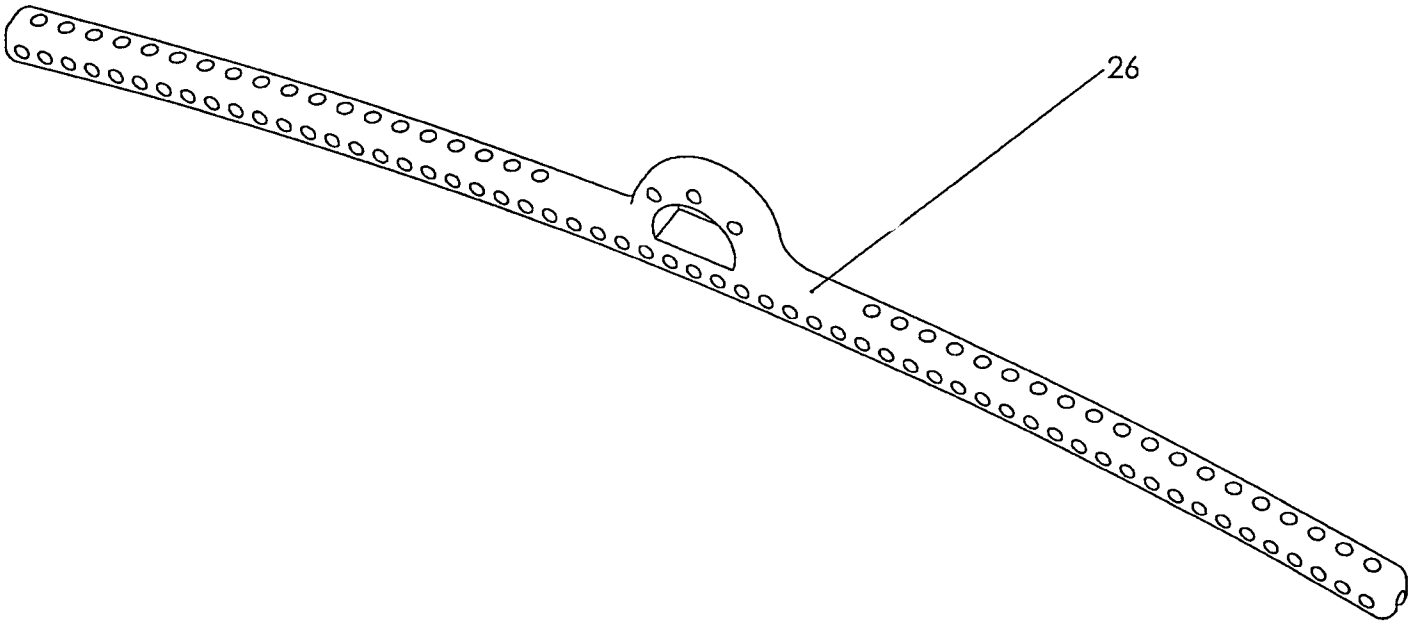
FIG. 7 illustrates further detail of a washing hanger that is used to suspend separate garments during a washing and/or drying cycle.

Further detail of the clothes hanger 26 and hanger mount 25 is illustrated in FIG. 7.

Figure 5:
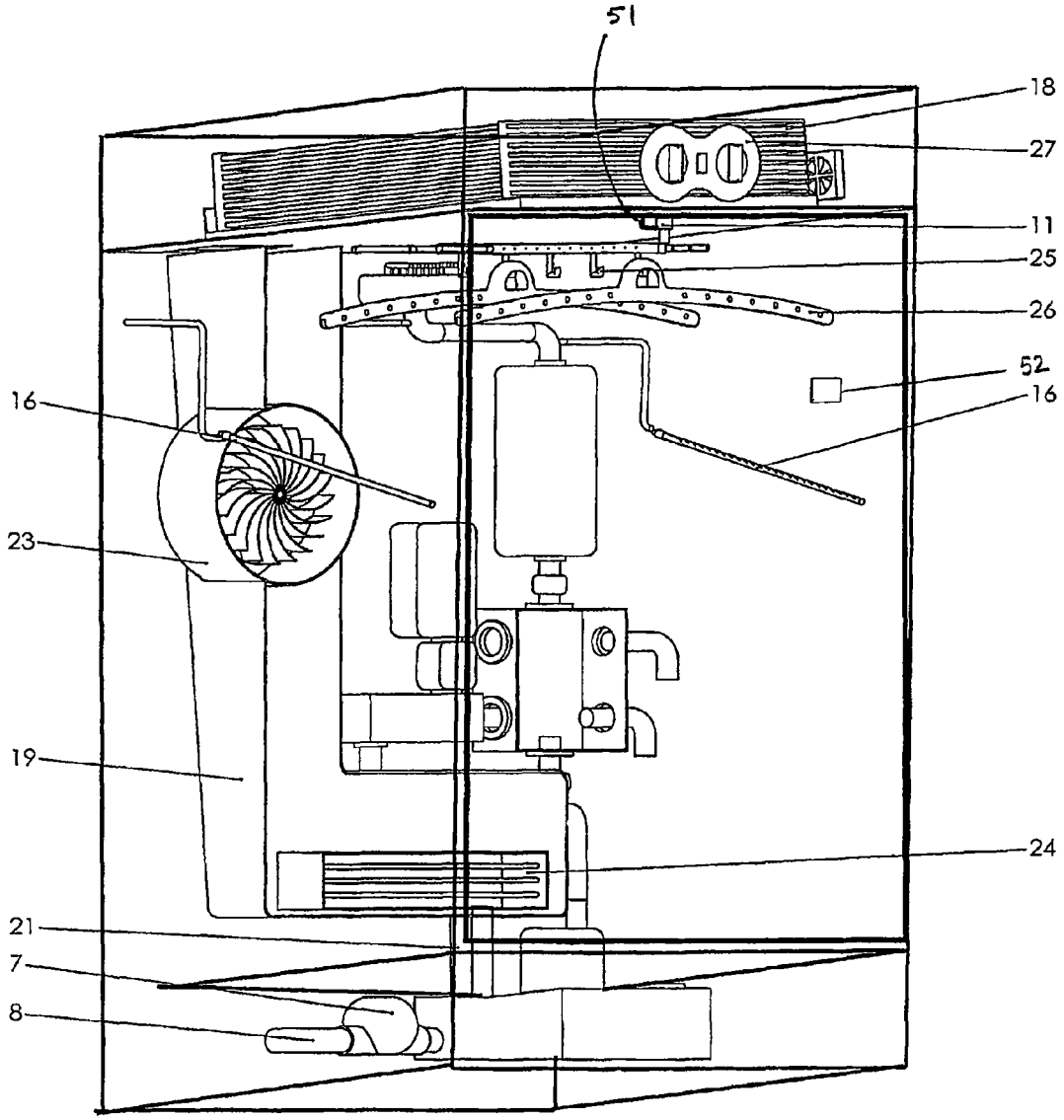
FIG. 5 illustrates a perspective cutaway view from the front of the apparatus according to the present invention.

After the predetermined cycle of washing and rinsing, the present invention also provides a drying cycle. During drying, the pressure, temperature and humidity of the air in the receptacle 29 is controlled such that the articles of washing are dried efficiently. As shown in FIGS. 3 to 5, the drying circuit essentially comprises an air heater 22, distribution fan 23 and dehumidifier unit 18 which circulates air in the receptacle 29. Essentially, dehumidified air from the dehumidifier 18 is drawn through the air duct 19, using fan 23, and such passes over heater element 22. The heated air is then blown into the receptacle 29 through the air diffuser 24 located towards the bottom of the receptacle 29. The dehumidified and heated air is then able to contact the articles of washing hung on the clothes hangers 26, and returns to the dehumidifier unit 18 via vents 17 situated at the top of the receptacle 29.

Air may then be taken from two sources; either re-circulated via vents 17 or from an external air intake fan 20, mounted at the top of the receptacle 29. The temperature and humidity of the air from either source is measured by temperature and humidity sensors (not shown); such temperature and humidity can be altered during the cycle by passing it through a dehumidifier 18 and through air heater 22, before it is circulated.

Following circulation, the moisture in the air is removed by the dehumidifier 18; such condensate then runs down duct 19 under gravity and is fed into the water sump collector 5, via the condenser waste pipe 21. In use, the control unit (not shown) operates all the air valves, as appropriate. As the garments are washed and dried separately, the creases that are associated with prior art washing machines are significantly reduced, and the garments are ready to wear without the further laborious and time-consuming task of ironing.

In use, it is also envisaged that a dirt detection device 52 is also situated in close proximity to the articles contained in the receptacle 29. The dirt detection device 52 being able to recognise various types of dirt or stains located on the washing articles from properties such as dirt particle size, chemical analysis or other transmission and/or reflection parameters. The output of the dirt detection device 52 is fed to the control unit, which then determines a preferred washing detergent and its concentration.

Further detail of the spray distribution nozzles 15, 16 is shown in FIG. 6, which are located above and at the side of the articles of washing. In essence, each nozzle comprises an elongate tubular member having various apertures located around its periphery and which are used to spray or direct water and/or water and washing medium onto the clothes from above and from the sides, as described above.

FIG. 7 shows further detail of the clothes hanger 26 that is used to accommodate separate articles within the receptacle 29. In use, the clothes hanger 26 includes a hanger mount 25 for ease of attachment to hanger rail 11. The clothes hanger 26 includes a plurality of apertures situated around its surface to minimise the contact area between such and the garment, and which could otherwise prevent efficient washing and drying of the garment.

Various alterations and modifications may be made to the present invention without departing from the scope of the invention. For example, although particular embodiments refer to domestic appliances, this is in no way intended to be limiting as, in use, the present invention may be implemented as a commercial or industrial washing machine or as a coin-operated machine in a launderette.

The invention claimed is:

1. An apparatus for washing garments, comprising:

at least one non-rotating receptacle for containing said articles, said at least one receptacle having a plurality of clothes hangers on which, in use, said garments are hung, said receptacle being free from rotational components and free from mechanical devices that agitate the garments;

a plurality of stationary spray distribution nozzles connected to a supply of water and a supply of detergent and positioned to spray a suitable quantity of water and detergent onto said garments hung from said clothes hanger; and a control panel for selecting a predetermined cycle of washing and rinsing.

2. The apparatus as claimed in claim 1, wherein the at least one receptacle comprises a non-rotating drum or other container to accommodate the articles, water and detergent mixture.

3. The apparatus as claimed in claim 2, wherein the at least one receptacle comprises as cabinet or enclosure which can be accessed via a door or hatch.

4. The apparatus as claimed in claim 1, wherein each of said plurality of clothes hangers includes a hanger mount for ease of attachment to a hanger rail in said at least one receptacle.

5. The apparatus as claimed in claim 1, wherein each of said plurality of clothes hangers includes a plurality of apertures situated around its surface to minimize a contact area between said clothes hangers and said articles.

6. The apparatus as claimed in claim 1, wherein said plurality of spray distribution nozzles comprises a plurality of overhead spray distribution nozzles located at a top of said at least one receptacle and a plurality of side spray distribution nozzles located at a side of said at least one receptacle.

7. The apparatus as claimed in claim 6, wherein the location of said plurality of overhead spray distribution nozzles ensures that said overhead spray distribution nozzles are located to spray a liberal supply of water and detergent towards an area where a neck and shoulders of one of said articles hung on ones of the clothes hangers would be located.

8. The apparatus as claimed in claim 1, wherein each of said plurality of spray distribution nozzles comprises an elongate tubular member having various apertures located around its periphery and which are used to direct said suitable quantity of water and detergent onto said separate articles.

9. The apparatus as claimed in claim 1, further comprising at least one strain gauge or other transducer situated in said at least one receptacle for measuring an overall weight of said articles.

10. The apparatus as claimed in claim 1, further comprising an air heater and dehumidifier for controlling the pressure, temperature and humidity of air in said at least one receptacle during a drying cycle.

11. The apparatus as claimed in claim 1, further comprising a dirt detection device situated in close proximity to said articles contained in said at least one receptacle.

12. The apparatus as claimed in claim 11, wherein said dirt detection device is able to recognize various types of dirt or stains located on said articles from properties such as dirt particle size, chemical analysis or other transmission and/or reflection parameters.

13. The apparatus as claimed in claim 1, wherein each of the nozzles is in a fixed position.

14. The apparatus as claimed in claim 1, wherein said plurality of spray distribution nozzles includes a plurality of side spray distribution nozzles located in a vicinity where armpits of the garments will be positioned when hung on the clothes hangers.

15. The apparatus of claim 14, wherein the plurality of side spray distribution nozzles comprises a pair of an elongate tubular members, each tubular member having various apertures located around its periphery; and further wherein the tubular members are located below the plurality of clothes hangers and offset from each other so as to be located in the vicinity where armpits of the garments will be positioned when hung on the clothes hangers.

* * * * *